US006065758A

United States Patent [19]

Steinhauser, Jr.

[11] Patent Number: 6,065,758

[45] **Date of Patent: *May 23, 2000**

[54] SKATE

[75] Inventor: Paul M. Steinhauser, Jr., Davison, Mich.

[73] Assignee: Victor Posa, Grand Blanc, Mich.; a part interest

[ * ] Notice: This patent is subject to a terminal disclaimer.

[21] Appl. No.: 09/199,010

[22] Filed: Nov. 23, 1998

Related U.S. Application Data

[63] Continuation of application No. 08/367,795, Dec. 30, 1994, Pat. No. 5,845,927.

[51] Int. Cl.[7] ..... A63C 1/16

[52] U.S. Cl. ..... 280/7.14; 280/11.27; 280/11.3

[58] Field of Search ..... 280/7.12, 7.13, 280/7.14, 11.19, 11.27, 11.3, 11.31, 11.32, 11.33, 11.34

[56] References Cited

U.S. PATENT DOCUMENTS

| | | | |
|---|---|---|---|
| 2,244,719 | 6/1941 | Mansfield . | |
| 2,868,553 | 1/1959 | Rieckman . | |
| 2,998,260 | 8/1961 | Meyer . | |
| 3,043,600 | 7/1962 | Voakes . | |
| 3,292,940 | 12/1966 | Weitzner . | |
| 3,526,976 | 9/1970 | Jacobs . | |
| 3,918,901 | 11/1975 | Peters . | |
| 4,008,901 | 2/1977 | Conn . | |
| 4,114,295 | 9/1978 | Schaefer . | |
| 4,150,499 | 4/1979 | Wang . | |
| 4,328,627 | 5/1982 | Sanders . | |
| 4,657,265 | 4/1987 | Rutt . | |
| 4,932,675 | 6/1990 | Olson . | |
| 4,988,122 | 1/1991 | Saunders . | |
| 5,046,746 | 9/1991 | Gierveld . | |
| 5,193,827 | 3/1993 | Olsen . | |
| 5,314,199 | 5/1994 | Olsen et al. . | |
| 5,503,412 | 4/1996 | Hill . | |
| 5,524,912 | 6/1996 | Laub et al. . | |
| 5,531,462 | 7/1996 | Gu . | |
| 5,662,338 | 9/1997 | Steinhauser, Jr. | 280/7.14 |
| 5,810,368 | 9/1998 | Steinhauser, Jr. | 280/7.14 |
| 5,839,734 | 11/1998 | Steinhauser, Jr. | 280/7.14 |
| 5,845,927 | 12/1998 | Steinhauser, Jr. | 280/7.14 |

*Primary Examiner*—Richard M. Camby
*Attorney, Agent, or Firm*—Young & Basile, PC

[57] ABSTRACT

An adapter plate having a central portion attached to a shoe body includes a depending peripheral sidewall forming a recessed cavity with the central portion which detachably receives a complimentary shaped attachment plate forming a part of an interchangeable attachment. A plurality of different attachments, each having a distinct use, may be interchangeably mounted in the adapter plate. The adapter plate is fixedly connected to the sole of the shoe body or integrally molded as a unitary part of the shoe body to the sole of the shoe body. Fasteners mounted on one of the adapter plate and the attachment releasably engage the other of the adapter plate and the attachment plate for releasably mounting one of the attachments to the shoe body.

4 Claims, 6 Drawing Sheets

SKATE

CROSS REFERENCE TO RELATED APPLICATION

This application is a continuation of application Ser. No. 08/367,795 filed Dec. 30, 1994, now U.S. Pat. No 5,845,927, issued Dec. 8,1998 the contents of which are incorporated by reference.

BACKGROUND OF THE INVENTION

1. Field of the Invention

The present invention relates, in general to skates.

2. Description of the Art

Ice skates, roller skates and, more recently, in-line roller skates have been used by many for enjoyment as well as to play various sports, such as hockey. The recently popular in-line roller skates have also been used by serious hockey players for off season training as well as to play hockey using on a non-ice surface.

In all types of skates, the ice blades, the toe and heel roller skate assemblies, and the in-line assembly containing a plurality of urethane rollers are securely and generally permanently attached to the sole of a skate boot or shoe. This has resulted in the dedicated use of hockey skates, roller skates or in-line roller skates for a single activity or sport.

The advantages of providing such skates with easily attachable and detachable assemblies including ice blades, toe and heel roller assemblies, or an in-line roller assembly, has been noted and a large number of interchangeable or convertible skates have been devised. The use of such convertible skates provides the ability, in the case of ice skates and in-line roller skates, to easily switch between ice hockey and in-line roller skating without the need for and, more importantly, the expense of providing separate skate boots or shoes which represent a major part of the cost of a pair of ice skates or in-line roller skates. Thus, for example, a hockey player using a convertible skate could use the same pair of boots or shoes with ice blades to play ice hockey and then, with the removal of the ice blades and the attachment of an in-line roller assemblies to the same boot or shoe, to be able to use such in-line skates for exercise, enjoyment or to play hockey on a non-ice surface.

Such convertible skates also provide the user with an opportunity to have a second replacement set of ice blades, in-line roller assemblies, etc., for immediate use in the case of damage or dulling of the pair of blades or roller assemblies attached to the user's skate boots.

Although numerous convertible or replaceable skates have been previously proposed, the skate art still lacks a commercially viable convertible skate which meets the primary criteria of ease of attaching and detaching the blades or in-line roller assemblies to the skate boot and, more importantly, providing a rigid, secure attachment of the blade and roller assembly to the boot which does not exhibit any play or relative movement between the blade or roller assembly and the boot. One problem which hinders the easy attachment and detachment of the blades or in-line roller assemblies to the skate boot is that the previous convertible skate designs typically require a tool, such as a wrench, to fixedly join the blade or roller assembly to the skate boot.

Another problem which has impeded the widespread use of a commercially viable convertible skate is the design of previous convertible skates wherein the ice blades, or in-line roller assembly which, while being easily attachable and detachable from a skate boot, have different heights, when mounted on the boot, between the boot sole and the underlying ground, ice or use surface. This differing height between skate attachments provides difficulties to a user who must adjust to the different heights when switching between ice blades and in-line roller skate attachments. The height differences result in eye, hand and foot coordination difficulties and, in the case of the use of such convertible skates for playing hockey, require the user to resort to different length hockey sticks in order to accommodate the differing heights of the ice blades and in-line roller attachments. Further, the structure of prior art convertible skates results in the sole of the boot and therefore the feet of the user being elevated higher above the underlying surface than a conventional dedicated, non-convertible ice skate or in-line roller skate. This greater height from the underlying surface decreases maneuverability.

Thus, it would be desirable to provide a convertible skate in which a single skate or shoe body is capable of interchangeably receiving different attachments including ice blades, in-line roller assemblies, shoe soles, etc. It would also be desirable to provide a convertible skate in which such attachments can be quickly and easily attached to and removed from the shoe body particularly without the need for a separate tool. It would also be desirable to provide a convertible skate in which such attachments are securely attached to the shoe body without any relative movement in either longitudinal or lateral directions, with respect to the shoe body. It would also be desirable to provide a convertible skate in which the height of all of the attachments and the adapter used to mount the attachment on the sole of the shoe body is identical for all of the possible attachments usable with a single shoe body. Finally, it would be desirable to provide a convertible skate which positions the sole of the skate and therefore the feet of the user as close as possible to the underlying use surface.

SUMMARY OF THE INVENTION

The present invention is a convertible skate which is capable of interchangeably receiving various attachments, each capable of a different use.

According to the present invention, a convertible skate includes a shoe body and an adapter plate fixedly connected to the shoe body. The adapter plate has a central portion and a peripheral lip depending from the central portion away from the shoe body. An attachment is releasably mountable in the adapter plate. Means are provided for releasably connecting the attachment to the adapter plate.

Preferably, the attachment comprises one of a plurality of distinct attachments, each capable of a different use, which are interchangeably mountable in the adapter plate.

Each attachment includes an attachment plate which has one of an ice skate blade, in-line roller assembly, shoe sole, snow shoe, ice claws, etc., attached thereto. The attachment plate is shaped to fit in registry with the central portion and the peripheral lip of the adapter plate. In a preferred embodiment, the peripheral lip of the adapter plate is disposed at an obtuse angle with respect to the central portion of the adapter plate. Similarly, the plate of the attachment has a peripheral edge which is disposed at a complimentary obtuse angle to fit in registry with the lip of the adapter plate so as to prevent any relative movement in either the longitudinal or lateral directions between the attachment and the adapter plate.

The means for connecting the attachment to the adapter plate preferably comprises fastener means carried by the adapter plate which are releasably engagable with the attachment plate. In one embodiment, the fastener means comprises cam means mounted on and depending from the adapter plate and rotatable with respect to the adapter plate. The cam means is insertable through apertures formed in the attachment plate and, when rotated, cammingly engage the attachment plate to fixedly connect the attachment plate to the adapter plate. In one embodiment, the apertures in the attachment plate are slots extending inward from a peripheral edge of the attachment plate.

In another embodiment, the adapter plate is again fixedly connected to or integrally molded with the shoe and has a depending peripheral sidewall extending therefrom. The attachment plate carrying one of the interchangeable accessories has a shape and size to fit snugly within the confines of the peripheral sidewall of the adapter plate. A plurality of fasteners are mounted on the attachment plate and releasably engage fastener receiving means mounted in the adapter plate for releasably attaching the attachment plate to the adapter plate. Preferably, the fastener receiving means comprise a plurality of inserts or nuts having an internally threaded bore. The fastener receiving means are preferably fixedly mounted between the adapter plate and the shoe sole. In a preferred embodiment, when the adapter plate is integrally formed as a unitary molded piece with the shoe, the fastener receiving means is molded within the attachment plate. A depending clip may also be mounted in and extending below one end of the adapter plate for fixedly engaging a forward edge of the attachment plate.

Each fastener preferably includes an intermediate frustoconical surface which engages a conically shaped bore formed within the attachment plate to minimize lateral and longitudinal movement of the attachment plate relative to the adapter plate. Further, the fasteners carry a user engagable member, such as a disk having a serrated edge which permits manual tightening and loosening of the fasteners during attachment and detachment of the attachment plate with respect to the adapter plate. This eliminates the need for a separate tool to releasably mount the various attachments in the adapter plate. Alternately, a nut may be mounted on the exterior end of the fastener for receiving a suitable tool, such as a wrench, for further tightening of the fasteners if desired.

The plurality of attachments include an ice skate blade mounted in a support or housing which is fixedly connected to the attachment plate. Alternately, the attachment includes an in-line roller assembly including a plurality of in-line arranged rollers mounted in a support which is fixedly attached to the attachment plate. Further, the attachment may be a shoe sole which is fixedly attached to the attachment plate. Additional attachments may also include a speed skate blade, a figure skate blade, a snow ski, snow shoe, ice claw, etc.

In one embodiment, a sole is attached to the shoe body, with the adapter plate being fixedly connected to the sole. The sole may be formed as an integral molded part of the shoe body.

In another embodiment, the adapter plate is integrally molded as a unitary part of the sole of the shoe body or as the sole of the shoe body. In this embodiment, the connecting means comprises a plurality of inserts mounted in the adapter plate, each insert having an internal, threaded bore. A plurality of fasteners are extendible through the apertures in the attachment plate into the inserts to fixedly connect the attachment plate to the adapter plate.

The convertible skate of the present invention provides, for the first time, a commercially viable skate which is capable of interchangeably receiving one of a plurality of attachments, each designed for a different use. This permits a single shoe or skate body to interchangeably receive an ice blade, a roller skate assembly, an in-line roller assembly, or a shoe sole. The convertible skate of the present invention enables such attachments to be quickly and easily attached to and removed from the shoe body. More importantly, when any of the attachments are connected to the adapter plate on the shoe body, the complimentary-shaped design of the adapter plate and the attachment plate ensures that the attachment plate is fixedly connected to the adapter plate and is prevented from any relative movement, in either longitudinal or lateral directions with respect to the adapter plate fixedly mounted on the shoe body. This provides the rigid attachment of the ice blade, in-line roller assembly, etc., to the shoe body required by a serious sportsman or anyone using skates for various activities. At the same time, the convertible skate of the present invention includes uniquely designed interchangeable attachments in which each attachment has the same identical height from the ground or underlying surface engaging end to the opposite outer surface of the attachment plate mountable in the adapter plate to place the user's feet at the same height above the underlying surface regardless of which attachment is mounted on the shoe body. Further, the attachments for the present convertible skate are designed with a minimum height so as to position the sole of the boot and, therefore, the feet of the user as close as possible to the underlying use surface for greater maneuverability.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
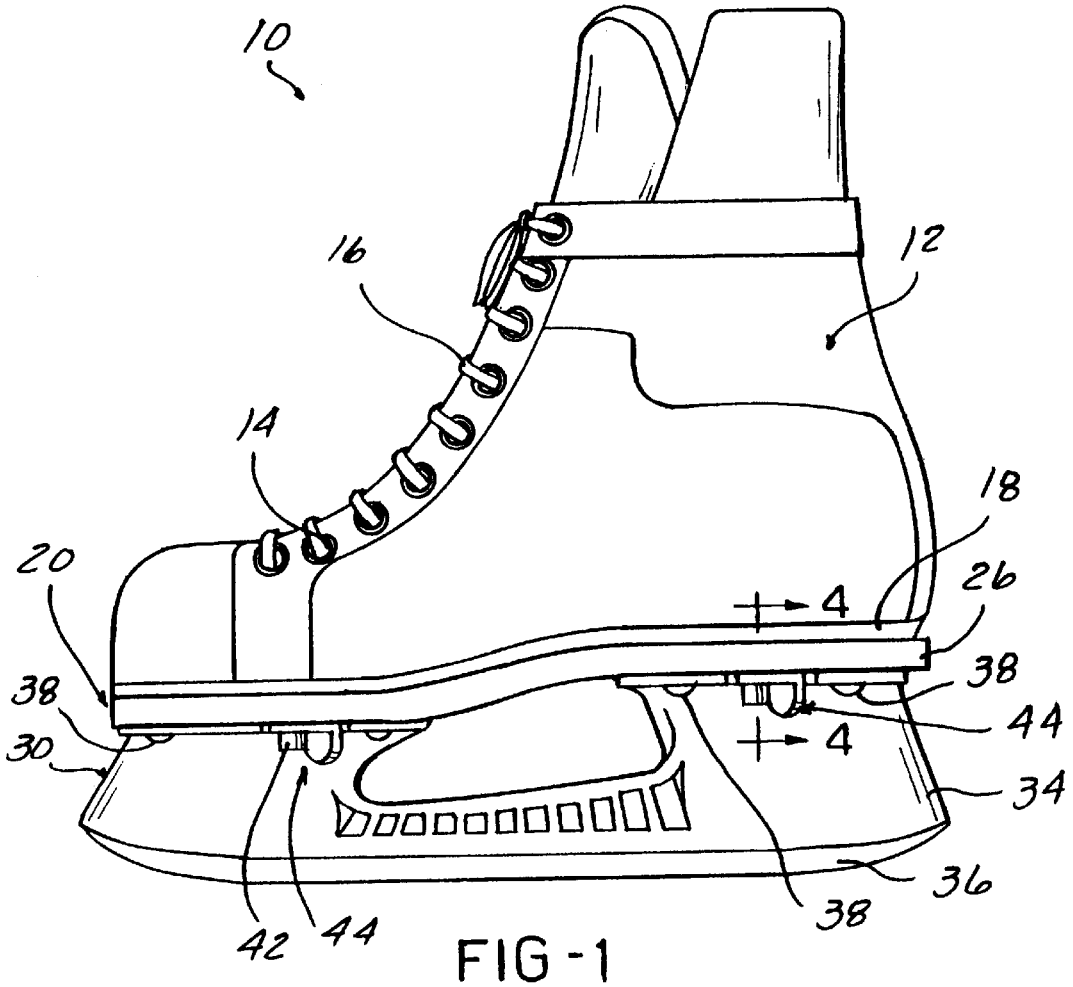
FIG. 1 is a side elevational view of a convertible skate constructed in accordance with the one embodiment of the present invention and shown as having an ice blade assembly mounted thereon.

Referring now to the drawings and to FIGS. 1–8 there is depicted several embodiments of a convertible skate denoted generally by reference number 10 which enables a single skate boot or shoe body to interchangeably receive one of a plurality of different attachments, such as an ice blade, an in-line roller assembly, a shoe sole, etc.

As shown in FIG. 1, the skate 10 includes a shoe body 12 of conventional construction. The shoe body 12 may be formed of any suitable shoe material, such as leather, rigid or soft plastic, or combinations thereof. A plurality of apertures 14 are provided on the shoe body 12 for receiving conventional laces 16. Other shoe securing means, such as clasps, etc., may also be employed on the shoe body 12.

In the embodiment shown in FIG. 1, the shoe body 12 has a sole 18 integrally formed therewith or attached to a bottom portion of the shoe body 12 in a conventional manner. The sole 18 may be formed of any suitable material, such as leather, plastic, etc.

Figure 2:
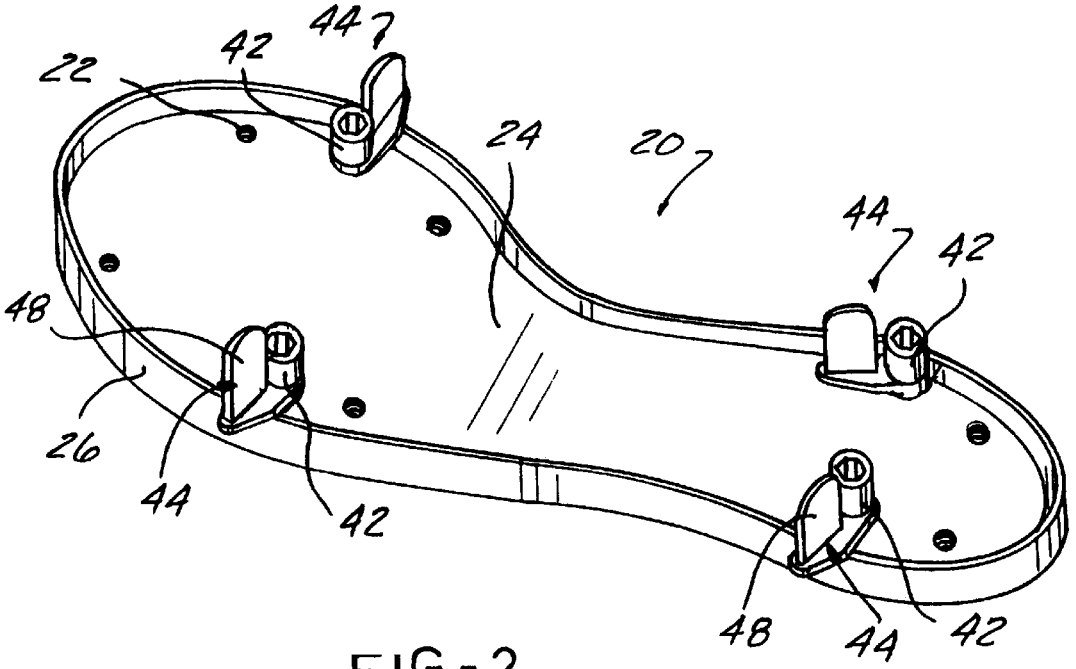
FIG. 2 is a bottom perspective view of the adapter plate of the convertible skate shown in FIG. 1.

According to the present invention, the convertible skate 10 includes an adapter means 20 generally in the form of a plate which is shown in greater detail in FIG. 2. The adapter means, hereafter referred to simply as the adapter plate 20, may be formed of any suitable material, such as metal, plastic, etc. However, plastic is preferred due to its light weight. Although the adapter plate 20 may have a generally planar form from a toe end to a heel end, preferably, the toe and heel ends are vertically offset, as shown in FIG. 1, as found in a normal shoe or boot. The adapter plate 20 is secured to the sole 18 of the shoe body 12 by means of suitable fastening means which may include the use of adhesives as well as various fasteners, such as screws, rivets, etc., which extend through apertures 22 formed in the adapter plate 20 into the sole 18.

Figure 4:
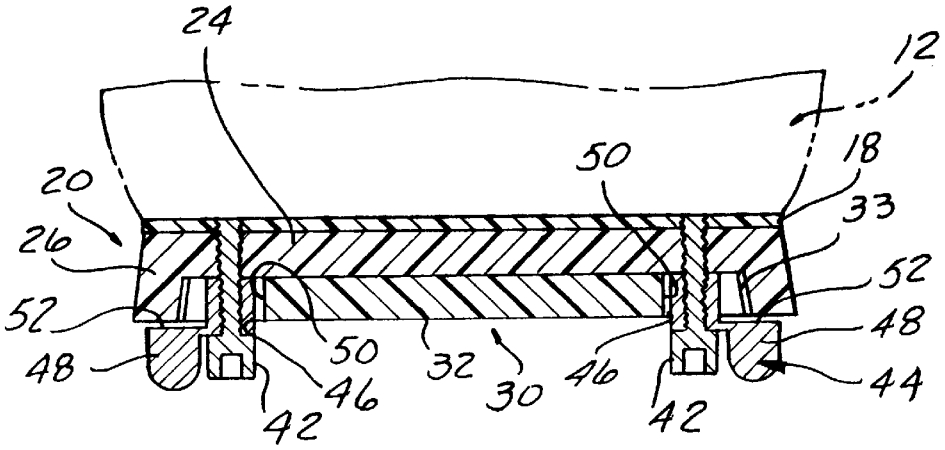
FIG. 4 is a cross-sectional view generally taken along line 4—4 in FIG. 1.

Generally, the adapter plate 20 includes a central portion 24 which has an exterior shape matching that of the sole 18. A sidewall 26 depends from the central portion 24 and forms a recessed cavity between the interior confines of the peripheral sidewall 26 and the central portion 24. The peripheral sidewall 26 is preferably disposed at an obtuse angle so as to extend angularly outwardly from normal to the plane of the central portion 18 as shown in FIG. 4. By way of example only, the peripheral sidewall 26 is disposed at a 1°–3° angle from normal to the central portion 24.

Figure 3:
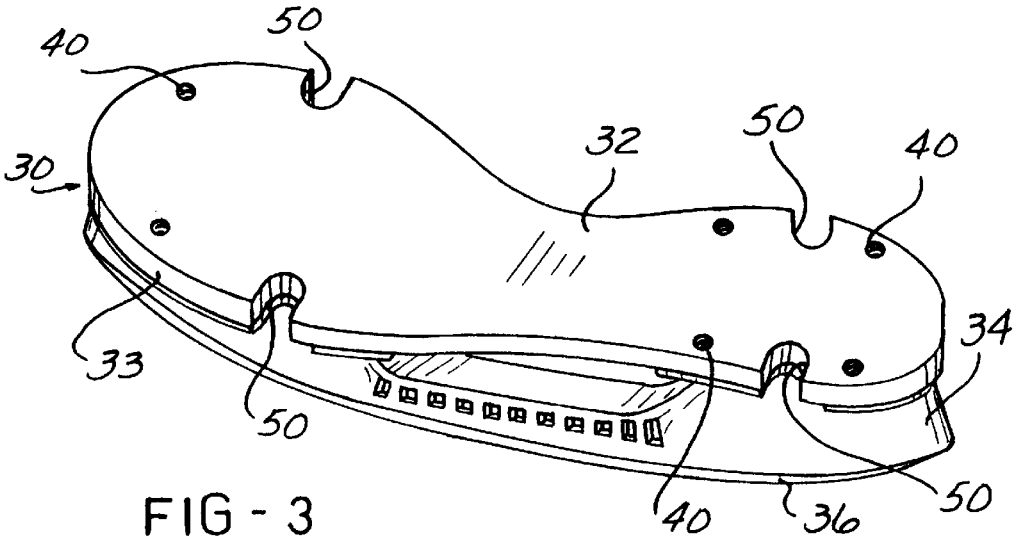
FIG. 3 is a perspective view of the ice blade assembly attachment shown in FIG. 1.
Figure 5:
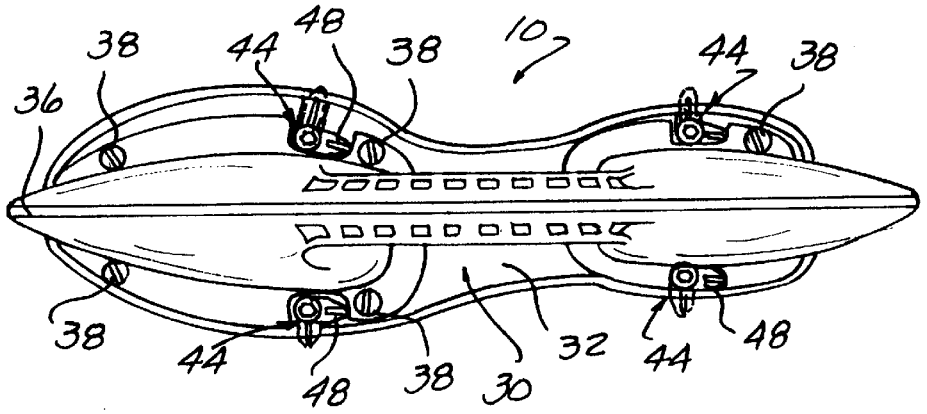
FIG. 5 is a bottom plan view of the ice blade embodiment of the convertible skate shown in FIG. 1.

An attachment denoted generally by reference number 30, as shown in FIG. 1 and in greater detail in FIGS. 3, 4 and 5, is detachably mountable in the adapter plate 20. Preferably, the attachment 30 is one of a plurality of distinct attachments, others of which are described in greater detail hereafter.

The attachment 30 includes an attachment plate 32 which has an overall size and shape so as to fit in substantial registry in the internal recess in the adapter plate 20 in tight, non-movable engagement with the central portion 24 and the sidewall 26 of the adapter plate 20. The peripheral edge 33 of the attachment plate 32 is formed at an angle with respect to the plane of the attachment plate 32 which is complimentary to the obtuse angle of the peripheral sidewall 26 of the adapter plate 20, i.e. 1°–3° in the noted example. A support or housing 34, which carries an ice blade 36 in the embodiment shown in FIGS. 1, 3 and 5 is mounted on the attachment plate 32. The support 34 is typically formed of a molded plastic, although metal may also be use, and is secured at an upper end to the attachment plate 32 by means of fasteners, such as screws 38, which extend through an upper mounting portion of the support 34 through apertures 40 in the attachment plate 32 to securely connect the support 34 and the ice blade 36 to the attachment plate 32.

According to the present invention, means are provided for releasably attaching the attachment plate 32 of the attachment 30 to the adapter plate 20. In one embodiment shown in FIGS. 1–5, the attaching means preferably comprises fastener means 42 depending from the adapter plate 20. Preferably, the fastener means 42 comprises a threaded Allen head screw which extends through the apertures 40 in the attachment plate 32 as well as through the apertures 22 in the central portion 24 of the adapter plate 20 into the sole 18 of the shoe body 12 to also serve to securely mount the adapter plate 20 to the sole 18 of the shoe body 12. A cam means denoted generally by reference number 44 is movably mounted about the threaded shank of each screw 42. The cam means 44 includes a hollow base 46 rotatably disposed about the shank of the screw 42 and an enlarged wing or pad 48 integrally formed with and extending outward from the base 46. As shown in FIGS. 2 and 4, the pad 48 is disposed adjacent to the head of the fastener 42 and is rotatable thereabouts. The screws 42 may be tightened so as to lock the fastener 44 and the pad 48 in a fixed position as described hereafter.

Engagement apertures 50 are formed in the attachment plate 32. The fasteners 42 on the adapter plate 20 extend through the apertures 50 in the attachment plate 32, as shown in FIG. 4, to enable the attachment plate 32 to be mounted on the adapter plate 20.

Four apertures 50, preferably in the form of slots extending from an open end on a peripheral edge 33 of the attachment plate 32, are provided by way of example only. Similarly, four fasteners 42 are mounted on the adapter plate 20.

In use, the screws 42 are loosened and the pads 48 of the fasteners 44 rotated to an outwardly extending position from the longitudinal center line of the adapter plate 20, as shown in phantom in FIG. 5. In this position, the pads 48 are in alignment with the longitudinal open extent of the slots 50 and permit the attachment plate 32 to be inserted into the recess in the adapter plate 20, with the apertures 50 passing over the pads 48 and the heads of the screws 42. The pads 48 are then rotated inward to the position shown in solid in FIG. 5. In this position, an inner surface 52 of the each pad 48 engages the surface of the attachment plate 32 in a camming action to force and retain the attachment plate 32 in secure, non-movable engagement with the adapter plate 20. The screws 42 may then be tightened to lock the pads 48 in a locking position to securely retain the attachment 30 in the adapter plate 20.

The sequence is reversed to release the attachment 30 including the attachment plate 32 from the adapter plate 20.

As shown in FIG. 4, when the attachment plate 32 is mounted in the adapter plate 20, in substantial registry with the central portion 24 of the adapter plate 20, the angularly disposed peripheral edge 33 of the attachment plate 32 engages the angularly disposed inner surface of the depending sidewall 26 of the adapter plate 20 in a tight, non-movable fit. This prevents any movement of the attachment plate 32 relative to the adapter plate 20 in either longitudinal or lateral directions thereby providing a secure, non-movable mounting of the attachment 30 to the adapter plate 20.

Figure 6:
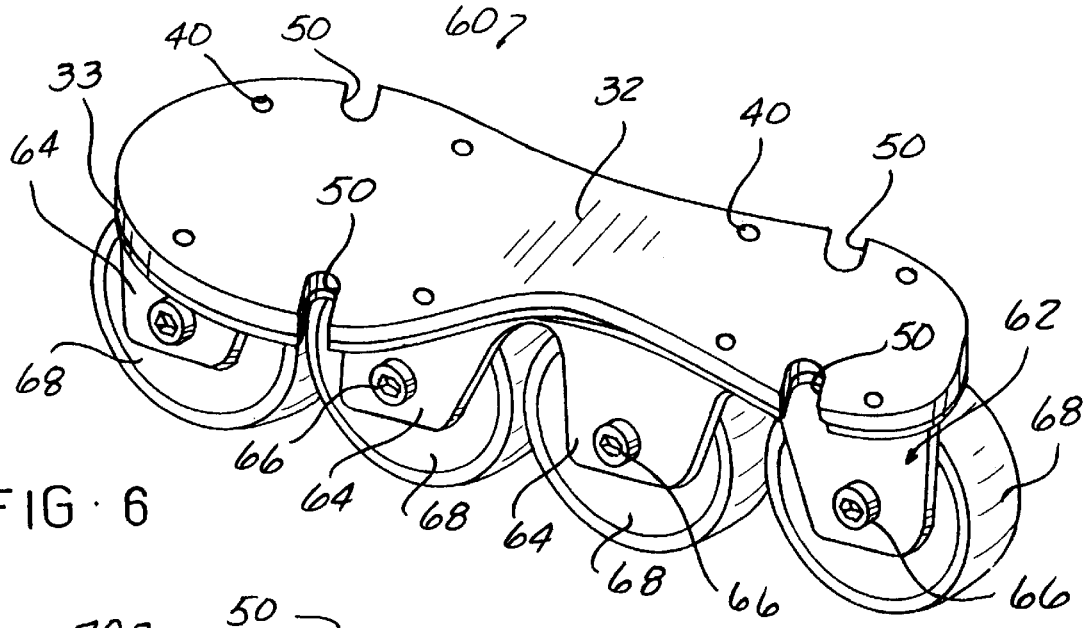
FIG. 6 is a perspective view of an in-line roller assembly attachment usable with the shoe body of the convertible skate shown in FIG. 1.

A different attachment 60, shown in FIG. 6, is also releasably mountable in the adapter plate 20 on the shoe body 12. The attachment 60 includes an in-line roller assembly denoted generally by reference number 62 which is secured at an upper portion to the attachment plate 32 by means of fasteners extending through the apertures 40 in the attachment plate 32. As shown in FIG. 6, the attachment plate 32 is also provided with a plurality of apertures 50, preferably in the form of open-ended slots extending inward from the peripheral edge 33 of the attachment plate 32.

The in-line roller assembly 62 may be of any conventional construction and includes a plurality of pairs of depending, spaced legs 64, each of which receives an axle 66 therethrough for rotatably mounting a roller 68 thereon. The attachment 60 is detachably mounted in the adapter plate 20 in the same manner as the attachment 30 described above.

It should further be noted that the attachments 30 and 60 are provided with identical heights from a lower ground or ice engaging surface of the blade 36 in the attachment 30 or the rollers 68 in the attachment 60 with respect to the upper surface of the attachment plate 32. In this manner, regardless of which attachment 30 or 60 is mounted on the shoe body 12, the height of the shoe body 12 with respect to an underlying surface is the same.

Figure 7:
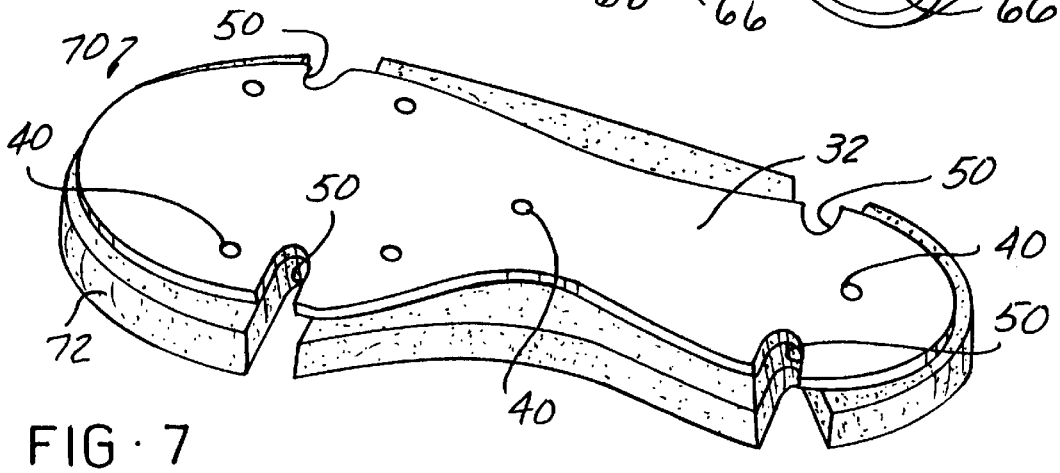
FIG. 7 is a perspective view of a shoe sole attachment usable with the shoe body of the convertible skate shown in FIG. 1.

Yeis alther attachment 70, shown in FIG. 7, is also releasably mountable in the adapter plate 20 on the shoe body 12. The attachment 70 also includes an attachment plate 32 having a plurality of apertures 50, such as open-ended slots, formed therein.

A conventional shoe sole 72 is attached to the adapter plate 32 in the attachment 70 by means of suitable fasteners extending through the sole 72 through the apertures 40 in the attachment plate 32. The sole 72 may be formed of any suitable material, such as a molded rubber or plastic, by way of example only. It should be noted that in the attachment 70, as well as in the previously described attachments 30 and 60, slots are formed in the sole 72 in line with the slots 50 in the attachment plate 32 to pass over the fasteners 42 on the adapter plate 20 when the attachment plate 32 is inserted in or removed from the adapter plate 20.

Figure 8:
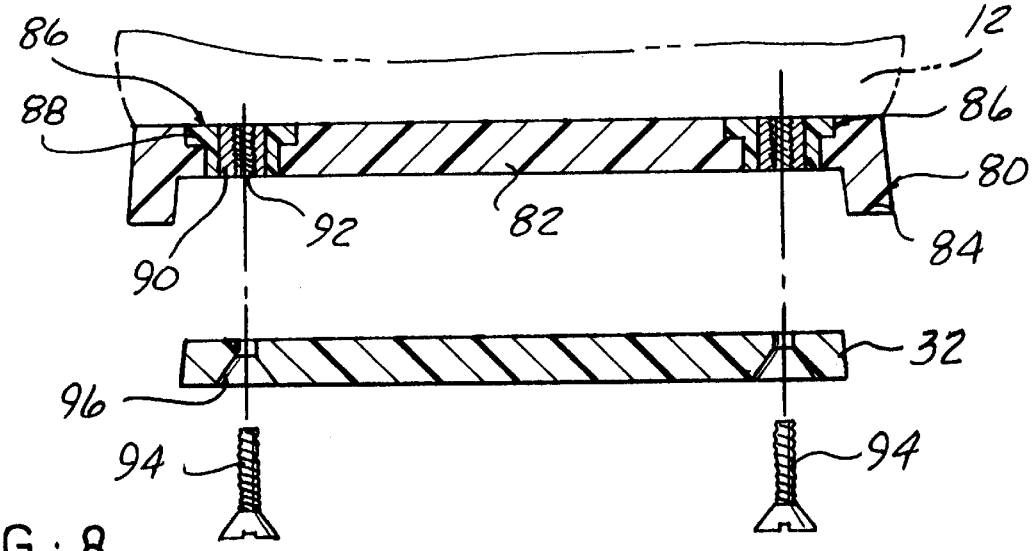
FIG. 8 is a cross-sectional view, generally taken along line 4—4 in FIG. 1, but showing an alternate embodiment of the connecting means used to connect the attachment plate of each of the various attachments to the adapter plate mounted on the shoe body.

Another embodiment of the convertible skate 10 of the present invention is shown in FIG. 8. This embodiment, which is usable with any of the attachments 30, 60 or 70 includes an adapter plate 80 having substantially the same construction as the adapter plate 20 described above and shown in FIGS. 1 and 2. However, in this embodiment, the adapter plate 80 forms the sole of the shoe body 12. Preferably, the adapter plate 80 is formed of a plastic material and is integrally molded as a unitary one-piece part of the shoe body 12. The adapter plate 80 also includes a central portion 82 and a depending peripheral sidewall 84 disposed at an obtuse angle with respect to the central portion 82 as in the adapter plate 20 described above.

In this embodiment, the means for attaching the various attachments to the adapter plate 80 includes a plurality, such as four by way of example only, of inserts 86 which are located about the periphery of the central portion 82 of the adapter plate 80. The inserts 86 are of conventional construction and are formed of a molded plastic body 88 having a through bore extending therethrough. A metallic sleeve 90 is press fit or otherwise fixedly mounted in the bore of the housing 88. The sleeve 90 has an internally threaded throughbore 92 formed therein.

The sleeves 90 threadingly receive fasteners 94, such as a flat head Allen screw or an Allen head cap screw, which extend through apertures 96 formed in the attachment plate 32 of any of the attachments 30, 60 or 70 described above to releasably mount the attachment plate 32 and the attachment mounted thereon to the adapter plate 80. It will also be understood that the cam-type fastener 44 described above and shown in detail in FIG. 4 can also be employed with the adapter plate 80 shown in FIG. 8.

FIGS. 9–16 depict other embodiments of the present invention. Components shown in FIGS. 9–15 which correspond to like components shown in FIGS. 1–8 are indicated by the same reference number.

Figure 9:
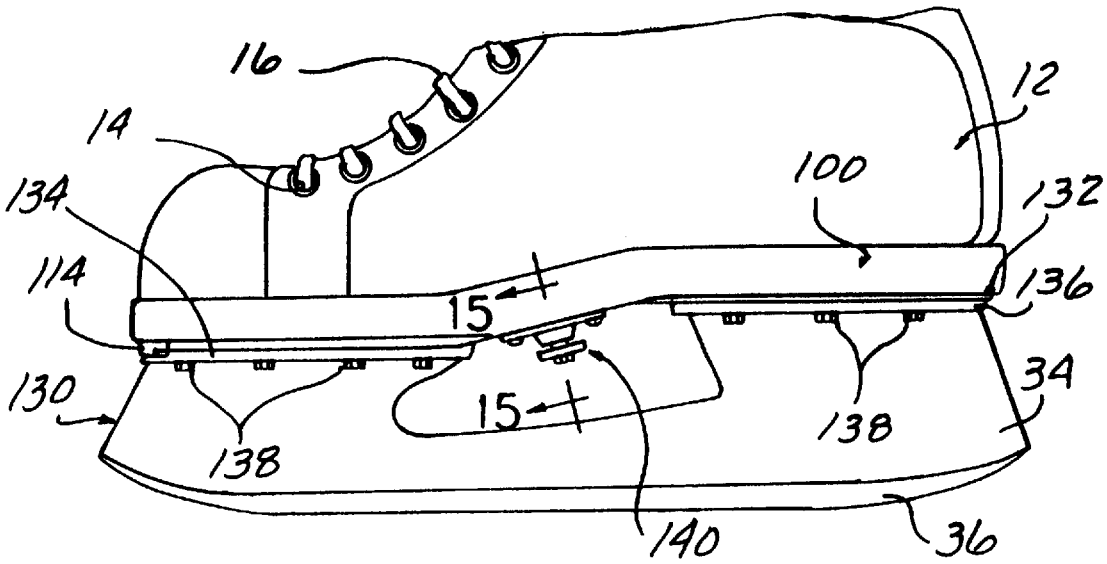
FIG. 9 is a partial side elevational view of another embodiment of the convertible skate of the present invention.
Figure 10:
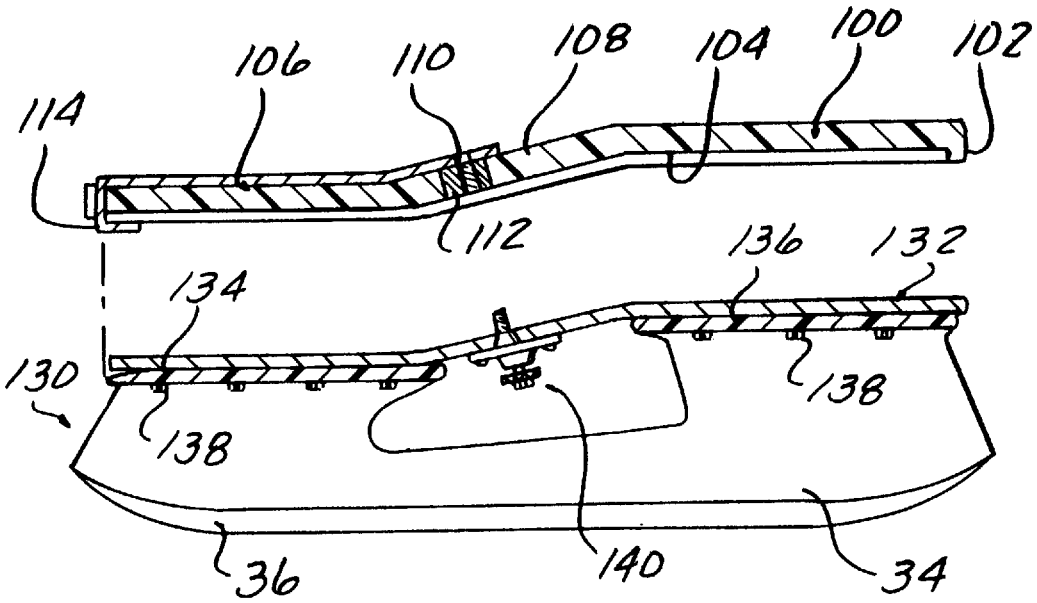
FIG. 10 is partially longitudinal cross sectional, exploded view showing the releasable engagement of the attachment to the adapter plate.

In this embodiment, an adapter plate 100 is integrally formed, such as by unitary molding, with the bottom portion of the shoe to form a one piece member as shown in FIGS. 9 and 10. In such an integral, one piece, molded construction, the adapter plate 100 actually forms the sole of the skate body. Accordingly, the adapter plate 100 is formed of a suitable high strength moldable material, such as plastic. As in the first embodiment, the adapter plate 100 includes a peripheral sidewall 102 depending from a central portion 104.

Figure 11:
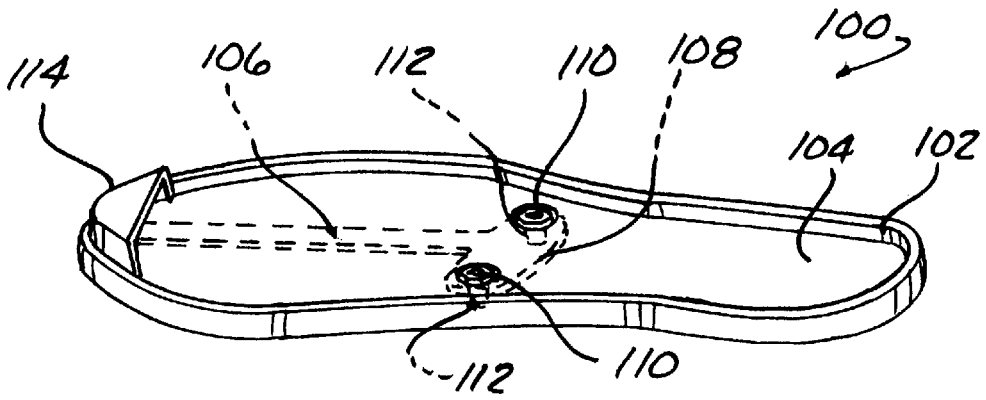
FIG. 11 is a bottom perspective view of one embodiment of the adapter plate shown in FIGS. 9 and 10.

In this embodiment, a backing member 106 is mounted within the adapter plate 100 and forms a portion of a fastener receiving means. The backing member 106 is preferably integrally molded in the adapter plate 100; although fasteners may also be employed for mounting. One embodiment of the backing member 106 is shown in FIGS. 10 and 11. In this embodiment, the backing member 106 is in the form of an elongated metallic strip having an enlarged first end 108 in which a pair of spaced through apertures 110 are formed. A fastener receiving means such as a threaded member 112, i.e. a nut, having an internally threaded bore is fixed, such as by welding, on the enlarged first end 108, with the bore in the nut 112, aligned with the apertures 110 in the backing member 106.

The forward or toe end of the reinforcing member 106 is provided with a cup-shaped member 114 which extends externally of the adapter plate 100 and below the edge of the sidewall 102. The cup-shaped member 114 has a generally semi-circular shape to define a hollow receptacle which engages the toe end of the attachment plate and aids in resulting lateral and longitudinal movement of the attachment relative to the adapter plate 100.

Figure 12:
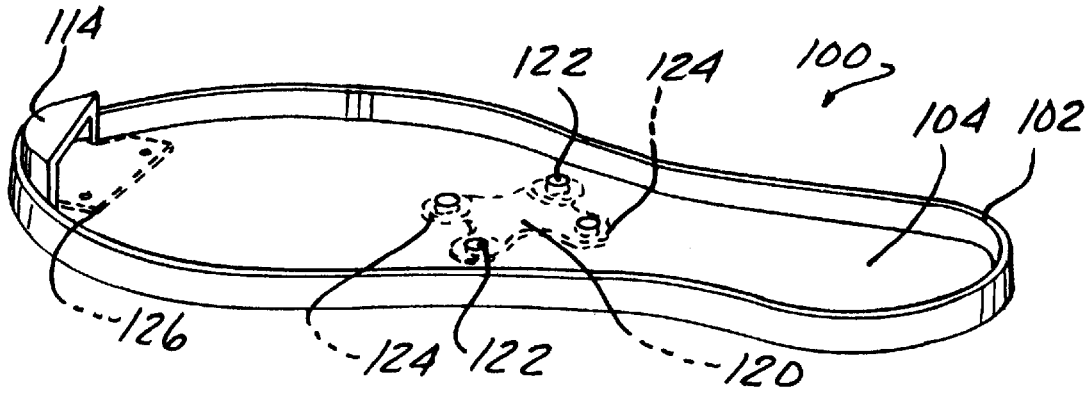
FIG. 12 is a bottom perspective view of another embodiment of the adapter plate.

An alternate embodiment of the backing member is shown in FIG. 12. In this embodiment, a small plate 120 is mounted on the adapter plate 100 by means of fasteners or by integral molding and has a pair of apertures 122 aligned with threaded nuts 112 welded on the plate 120. Intermediate outwardly extending flanges 124 are formed on the plate 120 for receiving mounting fasteners to fixedly attach the plate 120 to the adapter plate 100. In this embodiment, the cup-shaped member 114 is mounted to a separate plate 126 also attached to or integrally molded in the adapter plate 100 by means of fasteners.

Figure 13:
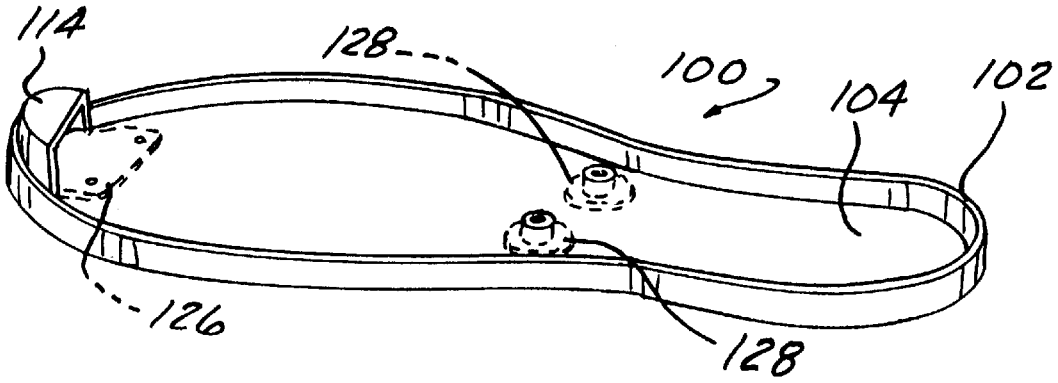
FIG. 13 is a bottom perspective view of yet another embodiment of the adapter plate.
Figure 14:
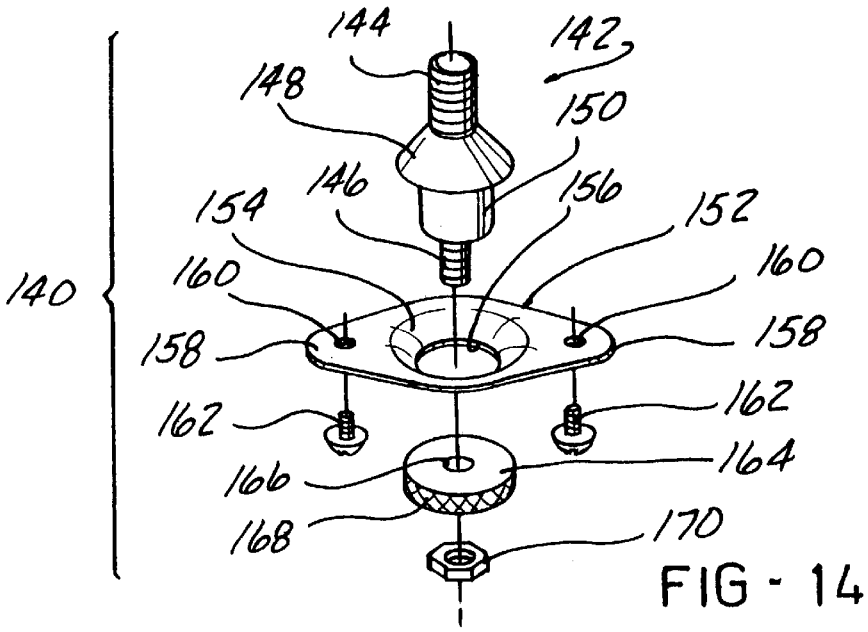
FIG. 14 is an exploded, perspective view of a fastener employed in the convertible skate shown in FIGS. 9 and 10.

Yet another embodiment of the backing member is shown in FIG. 13. In this embodiment, the cup-shaped member 114 is also formed as a part of a separate plate 126 attached to or integrally molded in the toe end of the adapter plate 100.

A pair of threaded inserts 128, similar to the inserts 86 described above and shown in FIG. 8, are mounted in or integrally molded in the adapter plate 100, with the threaded bore with the inserts 128 aligned with apertures formed in the adapter plate 100.

Referring again to FIGS. 9 and 10, one embodiment of an attachment 130 is depicted for releasable engagement with the adapter plate 100. In this embodiment, the attachment 130 is in the form of an ice blade having a blade 36 and a support housing 34, typically formed of a molded plastic. Although the support housing 34 may be integrally formed with an attachment plate 132, as described in another embodiment hereafter, in this embodiment, the support housing 34 is formed with toe and heel mounting flanges 134 and 136, respectively, which extend outward from the main body of the support housing 34. Apertures are formed in the flanges 134 and 136 and are aligned with correspondingly formed apertures formed in the attachment plate 132 to receive suitable fasteners 138, such as Allen head cap screws. It should be noted that the arrangement of the apertures correspond to a conventional international mounting hole pattern used in professional hockey skates. The fasteners 138 provide secure, yet releasable engagement of the attachment 130 to the attachment plate 132.

Figure 15:
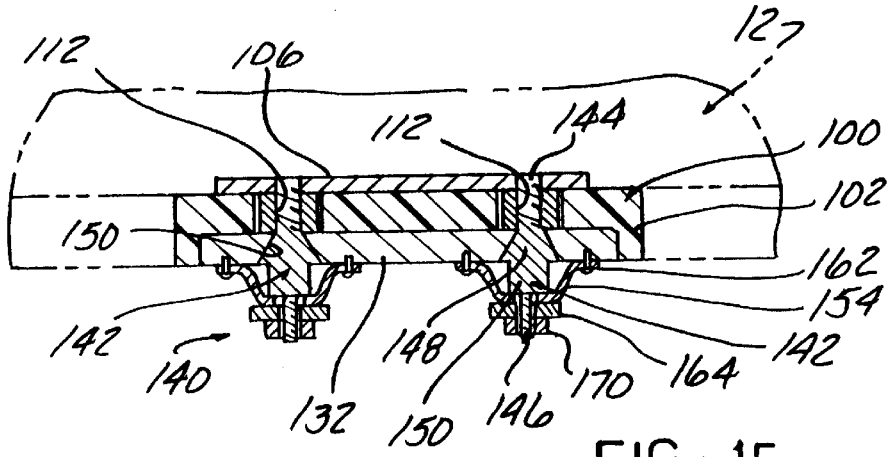
FIG. 15 is a cross sectional view generally taken along line 15—15 in FIG. 9.

Fastener means denoted generally by reference number 140 is mounted on the attachment plate 132 and releasably engage the fastener receiving means 112 in the adapter plate 100. Preferably two fastener means 140 are mounted substantially centrally between the toe and heel of the attachment plate 132 and are laterally spaced apart as shown in FIG. 15. As shown in FIGS. 9 and 10, and in greater detail in FIGS. 14 and 15, each fastener means 140 is formed of a shaft member 142 having opposed first and second threaded ends 144 and 146, respectively. An enlarged frustoconical shaped surface 148 is formed on the shaft 142 intermediate the first and second ends 144 and 146. A generally cylindrical shaft portion 150 is located between one end of the conical surface 148 and the second end 146.

The first threaded end 144 of the shaft 142 threadingly engages the fastener receiving means 112 and the apertures in the adapter plate 100 as shown in FIG. 15. During such mounting, the frustoconical surface 148 engages a complimentary formed conical bore 150 formed in the attachment plate 132. The use of mating conical surfaces provides secure attachment of the attachment plate 132 to the adapter plate 110 and minimizes any lateral and longitudinal movement of the attachment plate 132 relative to the adapter plate 110.

Each fastener means 140 also include a mount 152 having a depending, cup-shaped central portion 154 with a central aperture 156 formed therethrough. A pair of oppositely extending mounting flanges 158 extend from the cup-shaped portion 156 and each has an aperture 160 formed therein for receiving a suitable mounting fastener 162 to attach the mount 152 to the attachment plate 132.

In use, the mount 152 is affixed to the attachment plate 132 as shown in FIG. 15 by means of the fasteners 162. In this mounting position, the shaft 142 is held captive within the mount 152 yet is capable of a slight amount of movement relative to the attachment plate 132.

A user engagable member 164 generally in the form of a planar disk having a central aperture 166 and a serrated peripheral edge 168 is mounted on the second end 146 of the shaft 142 and provides a suitable user engagable surface for threadingly engaging the shaft 142 with the fastener receiving means 112 in the adapter plate 110 as well as enabling release of the attachment plate 132 from the adapter 110. This eliminates the need for a separate tool to attach and detach the attachment 130 to and from the adapter plate 110. Alternately, a nut 170 may be mounted about the exterior end of the second 146 of the shaft 142 adjacent to the disc 164 to permit the use of wrench to provide secure tightening or release of the fastener 140 to the adapter plate 110.

Figure 16:
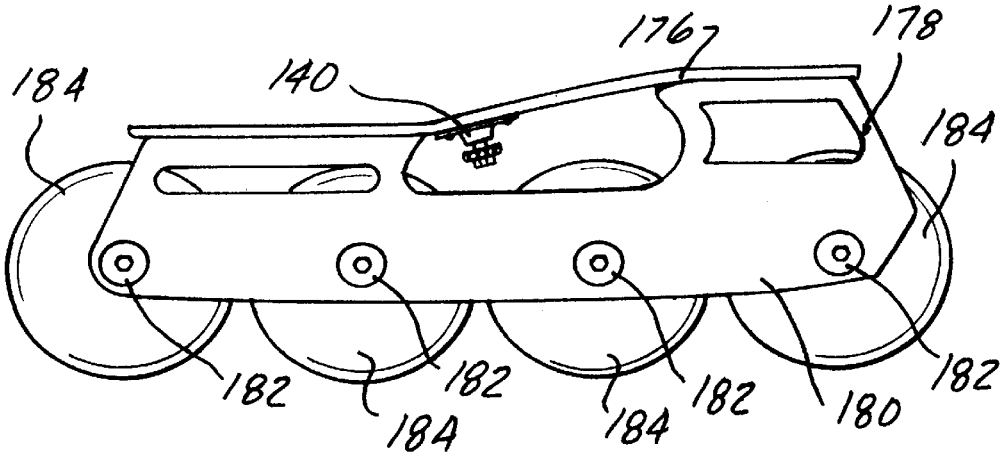
FIG. 16 is a side elevational view of a in line roller assembly attachment mountable in the adapter plate shown in FIG. 9.

FIG. 16 depicts another embodiment of the present invention in which an attachment plate 176, substantially identical to the attachment plate 132 described above and shown in FIG. 15, has a integrally molded in-line housing 178 extending from one surface thereof. One or more fasteners 140 are mounted on the attachment plate 176 in the same manner as described above and shown in FIG. 15.

The housing 178 includes a pair of spaced side legs which are integrally joined to the attachment plate 176 at an upper end. The opposite ends of the support legs 180 are spaced apart and receive a plurality of axles 182, each supporting a roller 184, as is conventional in the construction of in-line roller skates. The attachment and detachment of the housing 178 and the attachment plate 176 to the adapter plate 110 is the same as that described above for the other embodiments of the present invention.

The attachment plate 132 may also have a shoe sole, similar to sole 72 shown in FIG. 7 fixedly attached to or integrally molded thereto. Additional attachments, such as various skate blades including speed skate blades and figure skate blades, as well as snow shoes, ice claws, etc., may also be mounted on or integrally molded to one of the attachment plates described above.

In summary, there has been disclosed a unique convertible skate which enables a plurality of different skate attachments to be interchangeably mounted on a single skate body. At the same time, the convertible skate provides a secure mounting of the various attachments to the body of the skate without any relative movement between the attachments and the body in either the longitudinal or lateral directions. In addition, the various attachments are designed with the same height between an underlying surface engaging end and an upper portion mountable in the adapter plate attached to the shoe body so as to provide the same height and/or feel to a user regardless of which attachment is mounted on the shoe body. Further, the attachments have a low overall height to locate the boot sole and, therefore, the user's feet as low as possible to the underlying use surface for greater maneuverability of the skate.

What is claimed is:

1. A skate comprising:

a shoe body including a sole, the sole having a peripheral edge;

a peripheral lip depending from at least a portion of the peripheral edge and defining at least one recess between the lip and a portion of the sole interiorly of the peripheral lip;

a member having a side wall, the member fixedly mounted in the at least one recess with the side wall of the member in substantial registry with the peripheral lip; and a skate element fixedly mounted on the skate through the member.

2. The skate of claim 1 wherein the sidewall is unitarily formed as a one-piece part of the sole.

3. The skate of claim 1 wherein:

the sidewall depends from the entire peripheral edge of the sole.

4. The skate of claim 1 wherein the side wall of the member and the peripheral lip on the sole have complimentary formed registering shapes.

* * * * *